US005388630A

United States Patent [19]

Sano et al.

[11] Patent Number: 5,388,630

[45] Date of Patent: Feb. 14, 1995

[54] METHOD OF MANUFACTURING CORE AND MOLD

[75] Inventors: Hiroaki Sano; Takashi Yasukuni; Masaaki Ohata; Kiyotaka Nagai; Hiroshi Matsuura, all of Mihara; Kunio Koshiishi, Tokyo; Yasuyoshi Hirama, Tokyo; Kyozaburo Ogawa, Tokyo, all of Japan

[73] Assignees: Mitsubishi Jukogyo Kabushiki Kaisha; Kao Quaker Co., Ltd., both of Tokyo, Japan

[21] Appl. No.: 209,674

[22] Filed: Mar. 10, 1994

Related U.S. Application Data

[63] Continuation of Ser. No. 132,677, Oct. 6, 1993, abandoned, which is a continuation of Ser. No. 996,362, Dec. 23, 1992, abandoned, which is a continuation of Ser. No. 787,033, Nov. 4, 1991, abandoned.

[30] Foreign Application Priority Data

| | | | |
|---|---|---|---|
| Nov. 14, 1990 | [JP] | Japan | 2-306168 |
| May 15, 1991 | [JP] | Japan | 3-110428 |
| May 30, 1991 | [JP] | Japan | 3-127284 |
| Jun. 7, 1991 | [JP] | Japan | 3-136397 |

[51] Int. Cl.[6] ..... B22C 9/10; B22C 15/28

[52] U.S. Cl. ..... 164/39; 164/7.1; 164/40

[58] Field of Search ..... 164/7.1, 39, 40, 228

[56] References Cited

U.S. PATENT DOCUMENTS

| | | | |
|---|---|---|---|
| 4,129,165 | 12/1978 | Edwards | 164/7.1 |
| 4,531,565 | 7/1985 | Uzaki et al. | 164/7.1 |
| 4,567,932 | 2/1986 | Hollenbach | 164/7.1 |
| 4,600,046 | 7/1986 | Bailey et al. | 164/39 |
| 4,784,206 | 11/1988 | Sauerman et al. | 164/39 |
| 4,791,974 | 12/1988 | Larsen | 164/7.1 |

FOREIGN PATENT DOCUMENTS

| | | | |
|---|---|---|---|
| 0075854 | 6/1980 | Japan | 164/7.1 |
| 61-43417 | 2/1986 | Japan . | |
| 61-78478 | 5/1986 | Japan . | |
| 0260649 | 10/1988 | Japan | 164/39 |

*Primary Examiner*—P. Austin Bradley
*Assistant Examiner*—Erik R. Puknys
*Attorney, Agent, or Firm*—Anderson Kill Olick & Oshinsky

[57] ABSTRACT

A method of manufacturing a core and a mold for manufacturing a core or a mold using self-hardening molding sand or gas-hardening molding sand, wherein the self-hardening molding sand or the gas-hardening molding sand is charged in a core pattern or a flask while applying three-dimensional jolt, and a method of manufacturing a core and a mold for manufacturing a core or a mold using self-hardening molding sand, wherein air flow is precipitated by sucking the self-hardening molding sand in a core pattern or a flask.

7 Claims, 10 Drawing Sheets

METHOD OF MANUFACTURING CORE AND MOLD

This is a continuation application of Ser. No. 08/132,677, filed Oct. 6, 1993, now abandoned, which is a continuation application of Ser. No. 07/996,362, filed Dec. 23, 1992, now abandoned, which is a continuation application of Ser. No. 07/787,033, filed Nov. 4, 1991, now abandoned.

FIELD OF THE INVENTION AND RELATED ART STATEMENT

The present invention relates to a method of manufacturing a core and a mold, and more particularly to a method of manufacturing a core and a mold using self-hardening molding sand or gas-hardening molding sand.

A core means a part which forms the shape of a hallow portion of a casting product, and is generally manufactured with a sandmold. The configuration of the core is multifarious depending on a casting product.

Manufacture of a core using self-hardening molding sand has been heretofore performed by, for example, hand molding, by a machine, such as a jolt machine and a two-dimensional jolt molding machine, and by filling a mold utilizing air (a blowing method).

The method of filling molding sand utilizing air is used widely in mass production foundries as a method of molding a core with comparatively middle and small sized mass products as its objects.

In small quantity production of variety of products in which self-hardening molding sand is used for the core, the core is generally manufactured by hand molding only or a joint operation of molding by a machine (such as a jolt machine and a two-dimensional jolt molding machine) and that by hand.

FIG. 13 shows a method of manufacturing a core by hand molding. In FIG. 13, reference numeral 1 denotes a core pattern, 2 denotes self-hardening molding sand, and 9 denotes a rammer or a sand rammer.

The self-hardening molding sand 2 is charged into the core pattern 1 in an appropriate quantity, rammed with the rammer or the sand rammer 9 and left as it is until it self-hardens.

FIG. 14 shows a method of manufacturing a core using a two-dimensional jolt molding machine, in which 1 denotes a core pattern, 2 denotes self-hardening molding sand and 6' denotes a two-dimensional jolt molding machine.

The core pattern 1 is placed on the two-dimensional jolt molding machine 6', the self-hardening molding sand 2 is charged in an appropriate quantity into the core pattern 1, and the two-dimensional jolt molding machine 6' is operated to shake the pattern, so as to improve filling density of the self-hardening molding sand 2.

However, it is impossible to fill the self-hardening molding sand 2 to corner angle portions $A_1$, $A_2$, $A_3$, $A_4$, $A_5$, $A_6$ and others of the core pattern only with the shaking force of the two-dimensional jolt molding machine 6'. Therefore, supplementary hand molding for filling the self-hardening molding sand 2 to the corner angle portions $A_1$, $A_2$, $A_3$, $A_4$, $A_5$, $A_6$ and others of the core pattern 1 with a rammer or a sand rammer 9 becomes necessary.

After the core is manufactured, the core is taken out of the core pattern 1 after leaving it as it is until the self-hardening molding 2 hardens, similarly to hand molding shown in FIG. 13.

Such a method of manufacturing a core has problems as follows.

When a core having a complicated configuration is molded, it is required to ram the core by hand in order to realize the configuration of the core with certainty and to obtain a required core density.

Thus, in case of a core pattern having such a complicated configuration that ramming of the core by hand is difficult, the core is split. Therefore, after manufacture of the core is completed there occur such problems as that assembling the split cores is more time consuming, dimensional accuracy of the core deteriorates, burrs occur on a cast product.

Further, it is necessary to leave the core as it is for a certain period of time until the self-hardening molding sand hardens in the core pattern after manufacture of the core is completed. As a result, there are such problems as increased core molding periods, variation in time between the hardening and ejection of cores, deformation of cores at the time of ejection or after ejection (varying depending on ambient conditions).

A hand molding method and a molding method with a two-dimensional jolt molding machine are also adopted for the manufacture of a sandmold casting using self-hardening casting sand. In these manufacturing methods, the pattern is taken out of a flask after standing by for several tens of minutes to several hours until a chemical reaction between a resin for caking mixed in the molding sand and a hardening agent progresses and the mold hardens after the molding of the self-hardening mold is completed. FIG. 15 is a partial longitudinal sectional side view showing a method of manufacturing a self-hardening mold by hand molding, in which numeral 11 denotes a pattern, 12 a flask, 13 self-hardening molding sand, 17 a roller conveyor, 22 a sand rammer and 24 a surface plate.

In FIG. 15, the flask 12 is placed on the surface plate 24 on the roller conveyor 17, the pattern 11 is placed in the flask 12, and the self-hardening molding sand 13 is charged in an appropriate quantity in a void portion, formed with the pattern 11 and the flask 12 and is rammed with the sand rammer 22. After the mold is manufactured through repetitive operations of charging of the self-hardening molding sand 13 and ramming with the sand rammer 22, the mold is left as it is until it hardens.

FIG. 16 is a partial longitudinal sectional side view showing a method of manufacturing a self-hardening mold using a two-dimensional jolt molding machine, in which numeral 11 denotes a pattern, 12 denotes a flask, 13 denotes self-hardening molding sand, 14 denotes a vibrating table, 15 denotes air springs, 16 denotes shakers, 17 denotes a roller conveyor, 23 denotes a riser wood pattern and 24 denotes a surface plate. In FIG. 16, the flask 12 mounted on the surface plate 24 is placed on the vibrating table 14 of the two-dimensional jolt molding machine, the pattern 11 is placed in the flask 12, the self-hardening molding sand 13 is charged in the void portion formed with the pattern 11 and the flask 12, and it is intended to improve the filling density of the self-hardening molding sand 13 by shaking the two-dimensional jolt molding machine.

In this case, filling at a root portion of the riser wood pattern 23 and the like is not sufficient only by molding with shaking on the two-dimensional jolt molding machine. Therefore, it is also required to perform supplementary hand molding operation with a sand rammer or a rammer. Further, in case there is an attachment on the pattern, filling at the lower part of the attachment is liable to be insufficient, and thus hand operation is necessary in a similar manner to the above described case. After the mold is manufactured in such a manner, ejection is performed, that is, the pattern 11 and the riser wood pattern 23 are taken out after leaving the mold as it is until the self-hardening molding sand 13 hardens similarly to the case of hand molding.

According to the conventional methods of manufacturing a self-hardening mold shown in FIG. 15 and FIG. 16, there are such problems as follows First of all, it is required to increase the filling density of the self-hardening molding sand and to reduce the unevenness thereof in order to secure dimensional accuracy of a casting and to eliminate seizure, sand contamination and the like which are defects in casting complicating the fettling. However, it is insufficient by a conventional method, viz., the mold manufacturing method by hand molding or a two-dimensional jolt molding machine.

Further, the ejection time of the self-hardening mold depends on the atmospheric temperature, the sand temperature, the humidity, the quantity of resin added, the type of hardening agent, the quantity of a hardening agent added and the like. Therefore, it is difficult to control the ejection time, and such troubles as damages to a pattern and damages and deformations to a mold occur.

Furthermore, since the period for leaving the mold untouched in keeping with hardening from the completion of the molding to the ejection of the self-hardening mold is long, there is a drawback of obstructing productivity, too. On the contrary, if the hardening agent is adjusted so as to shorten the ejection time, such a problem is caused that hardening starts before the molding operation, and the period during which the molding sand can be used, viz., the spendable period is reduced by a large margin, thus making it difficult to produce a good mold.

In case of mass production of small products in which the weight of the molding sand is at 30 Kg/pc. or less, a gas hardening mold is produced by ventilating a gas which reacts with a caking agent added to the gas-hardening molding sand for hardening after the gas-hardening molding sand is blown into the flake or the core pattern by utilizing compressed air using a core shooter or a core blowing machine.

For molding a mold and a core in which the weight of the molding sand is at 30 Kg/pc. or more, or for molding molds and cores in small production lots, however, the molding by hand or by a two-dimensional jolt molding machine is adopted.

FIG. 17 and FIG. 18 show hand molding of a core using gas-hardening molding sand and core molding by a two-dimensional jolt machine. 51 denotes a core pattern, 52 denotes gas-hardening molding sand, 53 denotes a vent hole, 54 denotes a bypass hole for sand replenishment, 55 denotes a rammer and 56 denotes a two-dimensional jolt molding machine.

In molding a core by hand as shown in FIG. 17, the gas-hardening molding sand 52 is charged in the void portion of the core pattern 51 through a core print (an opening portion) of the core and a bypass hole 54 for sand replenishment, and the gas-hardening molding sand 52 is rammed with the rammer 55. Since the gas-hardening molding sand 52 cannot be filled in case of a core having a complicated configuration, sand charging and ramming operations are repeated. After molding of the core is completed, the molding sand is hardened by ventilating the core hardening gas.

FIG. 18 shows a molding method of a core using a two-dimensional jolt molding machine, in which, after a core pattern 51 is positioned on a two-dimensional jolt molding machine 56, gas-hardening molding sand 52 is charged in the void portion of the core pattern 51 through a core print (an opening portion) of the core and a bypass hole 54 for sand replenishment and the two-dimensional jolt molding machine 56 is turned on, so as to mold the core. Since portions ($B_1$), ($B_2$), ($B_3$) and others cannot be filled, however, it is required to mold the core by adopting hand-ramming operation with a rammer 55 jointly. After molding of the core is completed, the molding sand is made to harden by ventilating a core hardening gas.

FIG. 19 and FIG. 20 show hand molding of a mold using gas-hardening molding sand and molding of a mold by a two-dimensional jolt molding machine, respectively. 61 denotes a pattern, 62 denotes a flask, 63 denotes gas-hardening molding sand, 68 denotes a riser wood pattern, 69 denotes a sand rammer for ramming and 70 denotes a two-dimensional jolt molding machine.

In molding of a mold by hand as shown in FIG. 19, the flask 62 is installed on a surface plate 71 fitted with the pattern 61, the gas-hardening molding sand 63 is charged in the flask 62 thereafter, and the gas-hardening molding sand 63 is rammed with the sand rammer 69 for ramming, thus producing a mold. After manufacture of the mold is completed, the mold is hardened by ventilating a predetermined gas to the mold.

FIG. 20 shows molding of a mold using a two-dimensional jolt molding machine 70. A surface plate 71 fitted with a pattern 61 is placed on the two-dimensional jolt molding machine 70, and a flask 62 is arranged thereon. After a riser wood pattern 68 is set, gas-hardening molding sand 63 is charged in the flask 62, and the two-dimensional jolt molding machine 70 is turned on, so as to manufacture a mold. Thereafter, the mold is hardened by ventilating a predetermined gas to the mold. Since the molding sand is not filled sufficiently at the root portion of the riser wood pattern 68 only by shaking of the two-dimensional jolt molding machine, however, it is required to perform supplementary ramming with a sand rammer 69 for thrusting or by hand.

However, a mold or a core having a normal configuration is unobtainable in case of a complicated configuration by conventional methods of hand molding with gas-hardening molding sand and molding of a mold and a core by a two-dimensional jolt molding machine. Thus, delicate hand work is required, which causes an increase in molding process steps.

Further, the filling density of the mold or the core is low, and unevenness in molding is liable to be produced. As a result, dimensional accuracy of a casting is insufficient, and fettling becomes more complicated with occurrance of casting defects such as seizure and penetration.

OBJECT AND SUMMARY OF THE INVENTION

It is an object of the present invention to solve above-described problems when a core and a mold are manufactured using self-hardening molding sand or gas-hardening molding sand.

More particularly, it is a first object of the present invention to provide a method of manufacturing a core in which problems in molding performance and in points of quality of the core and the casting have been solved.

Further, it is a second object of the present invention to provide a method of manufacturing a self-hardening mold in which molding workability and workmanship of a self-hardening mold are excellent and problems in point of quality of a cast casting product can be solved.

Furthermore, it is a third object of the present invention to provide a method of manufacturing a gas-hardening mold and core in which problems in a conventional method have been solved so as to achieve sharp reduction of molding steps for gas-hardening mold and core, sharp reduction of fettling steps, improvement of dimensional accuracy of a casting or sharp reduction of defects (such as seizure and penetration) of a casting.

The first object of the present invention is achieved by a method of manufacturing a core in which there are provided means for speeding up air flow by sucking self-hardening molding sand in a core pattern and means for applying three-dimensional jolt to the core pattern, and self-hardening molding sand is charged while applying three-dimensional jolt to the pattern and air flow is speeded up by sucking the inside of the pattern after filling the inside of the pattern with the molding sand.

In the method of manufacturing a core, the molding sand flows into every nook and corner of the mold and minute filling is performed by applying three-dimensional jolt to the pattern when the self-hardening molding sand is charged or after charged in the core pattern. The moisture contained in the molding sand and the moisture generated by chemical reaction of the caking agent are removed by speeding up air flow by sucking the filled molding sand, thus accelerating hardening.

According to above-described method of manufacturing a core, it is possible to obtain following effects by providing means of speeding up air flow by sucking the inside of the core pattern and means of applying three-dimensional jolt to the core pattern by charging the self-hardening molding sand while applying three-dimensional jolt to the pattern and sucking the inside of the pattern so as to speed up air flow in the mold after filling the inside of the pattern with the molding sand.

(1) The core molding period can be reduced to $\frac{1}{3}$ to 1/5 of that by a conventional method.

(2) Ramming operation of the core by hand molding can be discontinued completely.

(3) The applicable range of molding the core as one body is enlarged remarkably. As a result, assembly and dimension check operations of a core become no longer required.

(4) Burrs on a casting disappear due to integration of the core, thus making it possible to reduce fettling periods sharply.

(5) Hardening period of the core is reduced to $\frac{1}{2}$, and productivity of the core is improved.

(6) Hardening of the core being uniform and well, the accuracy of the core is improved and the dimensional accuracy of a casting is also improved. Further, reduction of finishing cost is also made possible.

Further, the second object of the present invention is achieved by a method of manufacturing a self-hardening mold in which a flask is placed on a surface plate, a pattern is placed in a flask and self-hardening molding sand is charged in the flask, and the molding sand is filled between the pattern and the flask while applying three-dimensional jolt; a method of manufacturing a self-hardening mold in which a flask is placed on a surface plate, a pattern is placed in the flask and self-hardening molding sand is charged in the flask, the molding sand is rammed between the pattern and the flask, and air flow is accelerated by sucking the inside of the flask thereafter, thereby to dehydrate the moisture in the molding sand; and a method of manufacturing a self-hardening mold in which a flask is placed on a surface plate, a pattern is placed in the flask and self-hardening molding sand is charged in the flask, the molding sand is filled between the pattern and the flask while applying three-dimensional jolt, and air flow is accelerated by sucking the inside of the flask thereafter, thereby to dehydrate the moisture in the molding sand.

According to the above-described methods of manufacturing a self-hardening mold, the molding sand flows into every nook and corner of the pattern and minute filling is performed, thus making it possible to effect accurated molding by applying three-dimensional jolt to the flask and the pattern when the self-hardening molding sand is charged or after it is charged in the flask where the pattern is placed. Further, by sucking the molding sand filled in the flask, the moisture contained in the molding sand and the moisture generated by the reaction of the resin in a caking agent mixed in the molding sand and a hardening agent are transpired and the moisture in the flask is removed by suction, thus promoting hardening.

Therefore, according to the above-described methods of manufacturing a self-hardening mold, since self-hardening molding sand is filled between the pattern and the flask while applying three-dimensional jolt, it is possible to increase the filling density of the molding sand in the mold, and also to improve the filling at corner portions of the pattern and aim at improvement of dimensional accuracy of a casting product and reduction of fettling steps.

Further, there is an effect to make it possible to omit supplementary hand molding operation and increase productivity due to reduction of mold manufacturing period by the fact that filling property at corner portions of the pattern is improved.

Further, since air flow is accelerated by sucking the inside of the flask after filling the self-hardening molding sand between the pattern and the flask, the hardening period of the mold is reduced thereby to improve productivity, and in addition, dimensional accuracy of the mold is improved because hardening of the mold is uniform and well up to the depth thereof. As a result, such effects are obtainable that it is not only possible to reduce the working cost of a product, but also to reduce seizure defects and the like and reduce fettling steps.

Besides, the description, "air flow is speeded up by suction" in the present specification means to speed up the air flow in a mold forcibly by suction. There is such a method that the inside of the mold is suctioned with reduced pressure using a reduced-pressure suction unit such as a vacuum pump as means of "speeding up air flow by suction".

Furthermore, the third object of the present invention is achieved by a method of manufacturing a gas-hardening mold and core in which molding sand which hardens by gas ventilation is used and manufacturing is performed while applying three-dimensional jolt.

In the above-described method of manufacturing a gas-hardening mold and core, the mold or the core is manufactured by shaking the pattern or the core pattern while applying a shaking force preferably at 1 to 5 G and/or in a combination of jolt in three directions of X, Y and Z, in any two directions of X, Y and Z, and in any one direction of X, Y and Z.

In the above-described method of manufacturing gas-hardening mold and core, when a mold or a core is molded using gas-hardening molding sand, the gas-hardening molding sand is charged in an appropriate quantity into the flask or the core pattern, a shaking force is applied with a combination of jolt in three directions, jolt in two directions and jolt in one direction of a three-dimensional jolt molding machine, and the molding sand is moved to every nook and corner in the flask or the core pattern, thereby forming a mold or a core having minute filling density. After molding the mold or the core, a predetermined gas is ventilated so as to harden the mold or the core.

According to the above-described method of manufacturing gas-hardening mold and core, molding sand which hardens with gas ventilation is used and a mold and a core are manufactured while applying three-dimensional jolt, thereby to produce satisfactory results as follows.

(1) It becomes possible to reduce the molding periods of a mold and a core. In manufacture of a core in particular, the molding period can be reduced to about $\frac{1}{3}$ to 1/5 of that by a conventional method.

(2) Ramming work can be discontinued completely, thus making it possible to realize reduction of fatigue of skilled workers and mechanization or automation of a line easily.

(3) The filling density of a mold and a core is improved and filling nonuniformity disappears, thus improving dimensional accuracy of a mold.

(4) As a result, swelling of a mold at the time of casting molten metal or after casting the same can be reduced, the dimensional accuracy of a casting is made higher, and the yield is improved.

(5) Since casting defects such as seizure and penetration are reduced because of the improvement of the filling density of the mold, reduction of fettling steps and reduction of laborious work are made possible.

DETAILED DESCRIPTION OF PREFERRED EMBODIMENTS

The present invention will be described in more detail hereinafter with reference to embodiments, but the present invention is not limited thereto. <Examples of manufacturing a core using self-hardening molding sand>

Embodiment-1

Figure 1:
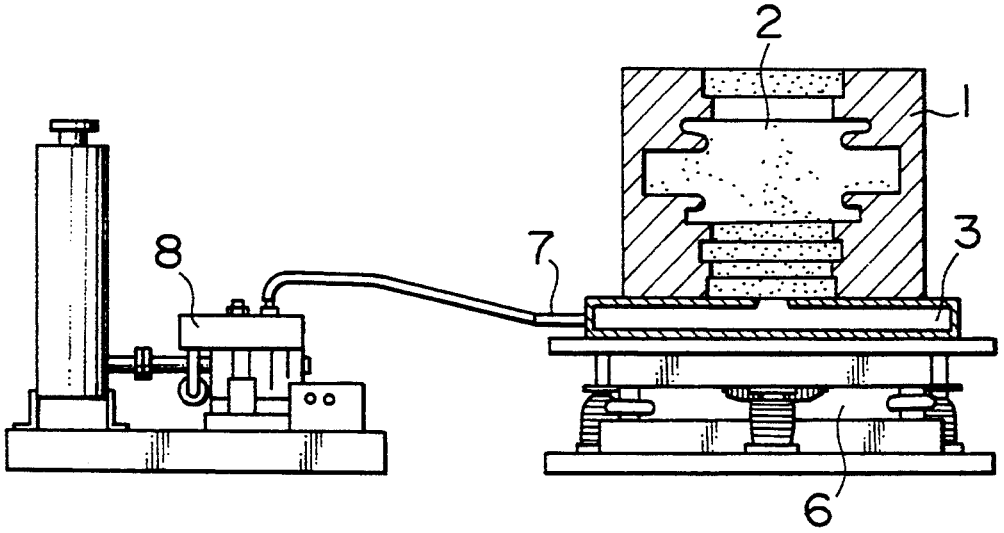
FIG. 1 is a longitudinal sectional view of an apparatus according to an embodiment 1 of the present invention.

In an embodiment 1 shown in FIG. 1, a core pattern 1 provided with a reduced-pressure suction box 3 or reduced-pressure suction means for core hardening is installed on a vibrating table of a three-dimensional jolt molding machine 6. After self-hardening molding sand 2 mixed at a separate location is added into the core pattern 1 in an appropriate quantity (such as $\frac{1}{2}$ of total sand quantity), the three-dimensional jolt molding machine 6 is actuated and jolt is applied in three directions, i.e., X-axis, Y-axis and Z-axis, so as to fill the self-hardening molding sand 2 in the core pattern. The three-dimensional jolt molding machine 6 is stopped, then an appropriate quantity (for example, $\frac{1}{4}$ of total sand quantity) of molding sand is charged in the core pattern, and the three-dimensional jolt molding machine 6 is actuated. Furthermore, residual quantity portion (for example, $\frac{1}{4}$) of the self-hardening molding sand 2 is charged in the core pattern 1, and jolt filling is performed again.

Immediately after core molding is completed, a reduced-pressure suction unit 8 is operated for several minutes, and the core is sucked through a suction pipe 7 and the reduced-pressure suction box 3 so as to cause the air flow in the mold, thereby to remove by dehydrating the moisture in the self-hardening molding sand 2 and the moisture generated when a caking agent reacts chemically, thus promoting hardening.

Next, concrete operation of the present embodiment will be described.

The shaking forces (frequencies) along X-, Y- and Z-axes of the three-dimensional jolt molding machine 6 were set at 50 hertz, respectively, the core pattern 1 having the core weight of 30 Kg was installed on a vibrating table, ½ of the total sand quantity of the furan molding sand 2 was charged in the core pattern 1, and jolt was applied for 10 seconds. Then, ¼ of the total sand quantity of the furan molding sand 2 was charged in the core pattern 1 and jolted for 20 seconds, and a little over ¼ of the total sand quantity of the furan molding sand 2 was charged further in the core pattern 1 and jolted for 30 seconds. After the core pattern was completed, the reduced-pressure suction unit 8 was actuated (for 5 minutes) so as to harden the core by speeding up air flow in the mold by sucking the core.

As to the ejected core, even a projected core print approximately 100 mm long was filled completely, and a good core which had been hardened up to the central part uniformly was obtainable. Table 1 shows hardening characteristics when air flow rate in the mold was accelerated for hardening by sucking the furan self-hardening sand.

TABLE 1

Hardening Characteristics by Suction of Furan Self-Hardening Sand

| Resin | | Hardening agent | | | Proof pressure | | |
|---|---|---|---|---|---|---|---|
| Type | % | Type | % | Suction | after 0.5 Hr | after 1 Hr | after 24 Hr |
| 340B | 1 | C-14 | 40 | no | 0 | 2.8 | 37.5 |
| 340B | 1 | C-14 | 40 | yes | 3.9 | 9.4 | 40.8 |
| 340B | 1 | TK-3 | 40 | no | 5.2 | 11.8 | 36.0 |
| 340B | 1 | TK-3 | 40 | yes | 13.6 | 28.2 | 39.5 |

Note)
Tested sand: Kaketsu Fusen No. 5
Ambient temperature: 28° C.
Humidity: 90% RH
Behavior of hardening: Uniform hardening to the depth

Embodiment-2

Figure 2:
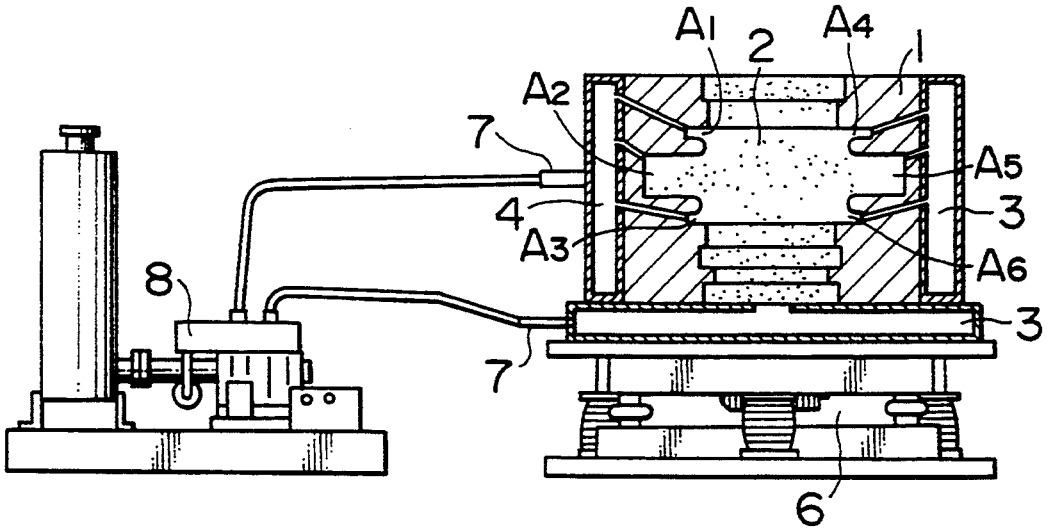
FIG. 2 is a longitudinal sectional view of an apparatus according to an embodiment 2 of the present invention.

FIG. 2 shows a second embodiment 2.

A core pattern 1 provided with intercommunicating pores 4 for reduced-pressure suction at portions $A_1$, $A_2$, . . . , $A_6$ where self-hardening molding sand 2 could not be filled in recessed portions of the core pattern 1 was installed on a three-dimensional jolt molding machine 6, the furan molding sand 2 was charged in the core pattern 1 while actuating a reduced-pressure suction unit 8, and the three-dimensional jolt molding machine 6 provided jolt for about 60 seconds keeping pace with the above, thus manufacturing the core. As the result of executing hardening by suction thereafter in a similar manner as the embodiment 1 a good core was obtainable.

Embodiment-3

Figure 3:
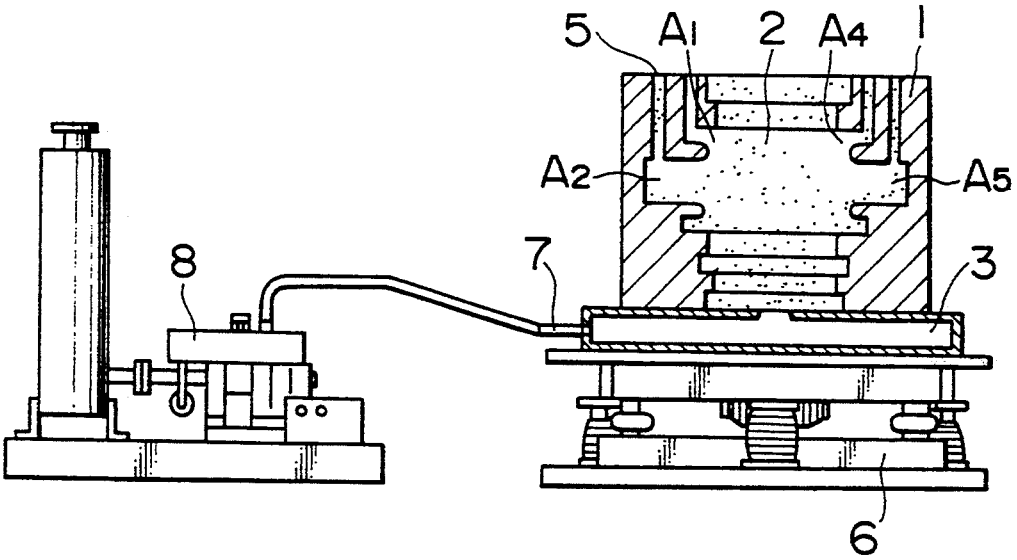
FIG. 3 is a longitudinal sectional view of an apparatus according to an embodiment 3 of the present invention.

FIG. 3 shows an embodiment 3.

After a core pattern 1 provided with holes 5 for sand replenishment each 15 mm square at recessed portions $A_1$, $A_2$, $A_4$ and $A_5$ of the core pattern 1 was installed on a three-dimensional jolt molding machine 6, ½ of total sand quantity of furan molding sand 2 was charged in the core pattern 1 and jolted for about 20 seconds. Then, the furan molding sand was charged in a supplemental manner through an upper part and holes 5 for sand replenishment of the core pattern 1 with jolt by the three-dimensional jolt molding machine 6 and was jolted for about 40 seconds. As the result of actuating a reduced-pressure suction unit 8 so as to promote hardening by suction after molding of the core was completed, a good core was obtainable.

Embodiment-4

Figure 4:
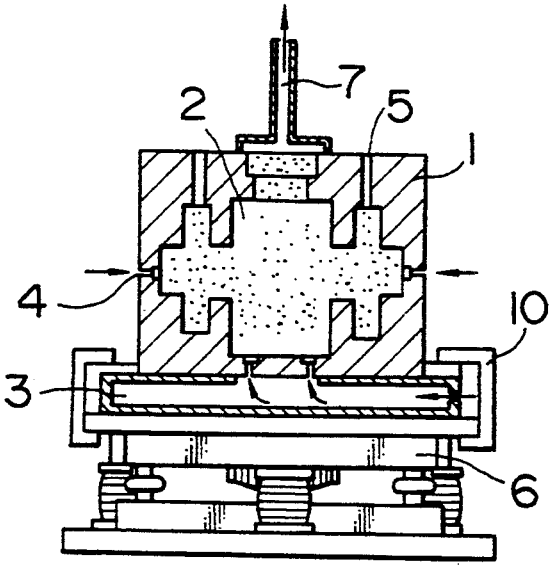
FIG. 4 is a longitudinal sectional view of an apparatus according to an embodiment 4 of the present invention.

FIG. 4 shows an embodiment 4 in which a core is hardened by sucking under reduced pressure from an upper part of a core pattern. A core pattern 1 provided with intercommunicating pores 4 for reduced-pressure suction and holes 5 for sand replenishment (omitted depending on the configuration of the core) is installed on a vibrating table of a three-dimensional jolt molding machine 6. A core is molded by shaking with the three-dimensional jolt molding machine 6 while charging self-hardening molding sand 2 mixed at a separate location in the core pattern 1 in parts by appropriate quantities.

As the result of operating a reduced-pressure suction unit not shown for several minutes after molding of the core was completed, accelerating air flow in the mold by sucking the core through a suction pipe 7 provided at the upper part of the core pattern 1, removing the moisture in the self-hardening molding sand 2 and the moisture generated at time of chemical reaction, and promoting hardening, the ejection period of the core could be reduced by half as compared with a conventional self-hardening method, and uniform hardening up to the depth of the core was realized.

Besides, 10 denotes a clamp in FIG. 4.

Embodiment-5

Figure 5:
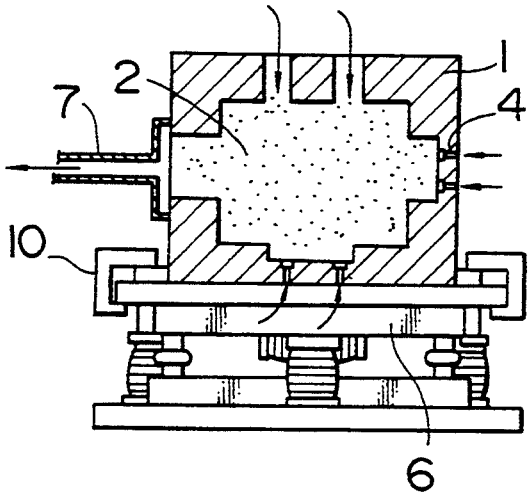
FIG. 5 is a longitudinal sectional view of an apparatus according to an embodiment 5 of the present invention.

FIG. 5 shows an embodiment 5 in which hardening is made by sucking under reduced pressure from a side of a core pattern.

The adding method and the shaking point of self-hardening molding sand 2 are similar to those in the embodiment 4.

Suction under reduced pressure was performed through the side portion of the core pattern 1, but satisfactory results similar to the embodiment 4 were obtainable in points of ejection period and hardened state.

<Examples of manufacturing a mold using self-hardening molding sand>

Figure 6:
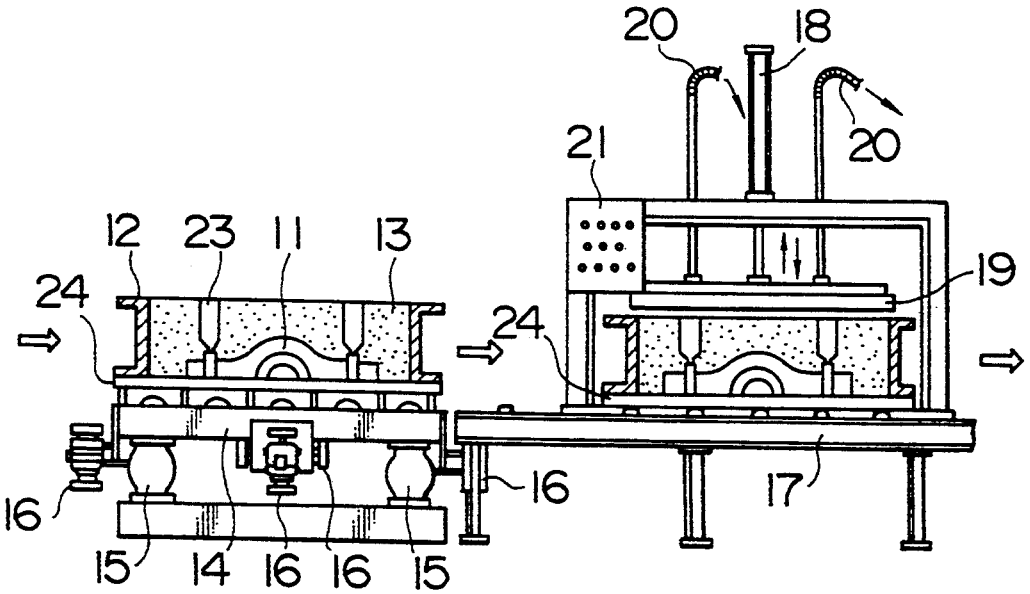
FIG. 6 is a partial longitudinal sectional side view of an apparatus according to embodiments 6 to 8 for executing a method of manufacturing a self-hardening mold of the present invention.

FIG. 6 shows an apparatus suitable for working of a method of manufacturing a self-hardening mold of the present invention.

FIG. 6 is a partial longitudinal sectional side view, in which 11 denotes a pattern, 12 denotes a flask and 13 denotes self-hardening molding sand, in which normal temperature self-hardening furan resin as a caking agent of the molding sand of a sandmold casting and a hardening agent are mixed. 14 denotes a vibrating table of a three-dimensional jolt molding machine, 15 denotes air springs, 16 denotes shakers, and 17 denotes a roller conveyor which conveys a surface plate 24 on which a flask 12 is placed. 18 denotes a vertical working cylinder, 19 denotes a surface plate for suction under reduced pressure, 20 denotes a suction pipe and 21 denotes a control board of a pressure reducing unit.

Next, an embodiment of a method of manufacturing a self-hardening mold of the present invention will be described.

Embodiment-6

As shown in FIG. 6, a flask 12 is placed on a surface plate 24, and a pattern 11 is placed in the flask 12 and a riser wood pattern 23 is fitted, which are installed on a vibrating table 14 of a three-dimensional jolt molding machine. After furan self-hardening molding sand 13 mixed by a sand mixer was charged in an appropriate quantity (for example, $\frac{3}{4}$ of the total sand quantity) in a void portion formed by the pattern 11 and the flask 12, the shakers 16 of the three-dimensional jolt molding machine were actuated so as to apply jolt in three directions of X-axis, Y-axis and Z-axis, thereby to fill the furan self-hardening molding sand 13 in the flask 12. Then, an appropriate quantity (for example, $\frac{1}{4}$ of the total sand quantity) of self-hardening molding sand 13 was charged in the flask 12 and jolt filling was performed again. After molding of the mold was completed, the mold was left as it is for 70 minutes until the mold hardened. As the result of ejection thereafter, a mold well-set in every nook and corner was obtained.

Embodiment-7

Figure 16:
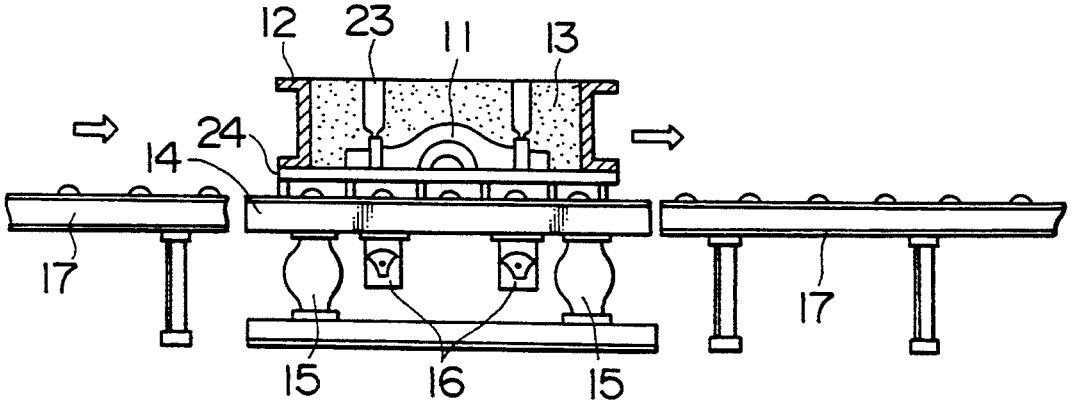
FIG. 16 PRIOR ART
FIG. 16 is a partial longitudinal sectional side view of another apparatus for executing a conventional method of manufacturing a self-hardening mold.
Figure 17:
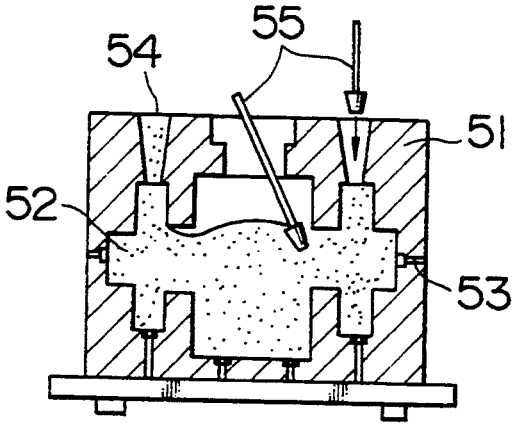
FIG. 17 PRIOR ART
FIG. 17 is a longitudinal sectional view of an apparatus for executing a conventional method of manufacturing a gas-hardening core by hand molding.
Figure 18:
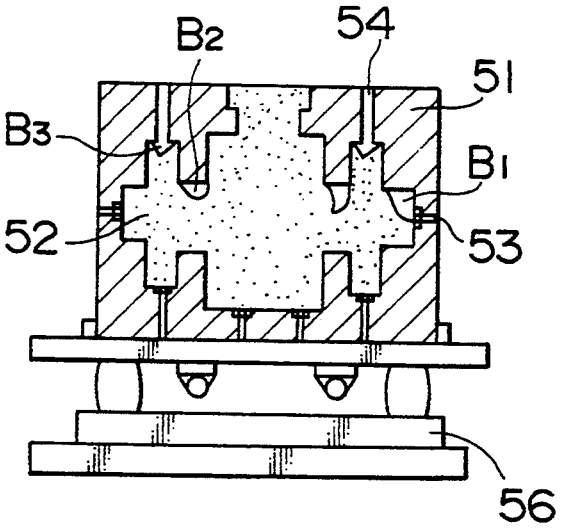
FIG. 18 PRIOR ART
FIG. 18 is a longitudinal sectional view of an apparatus for executing a conventional method of manufacturing a gas-hardening core by two-dimensional jolt molding.
Figure 19:
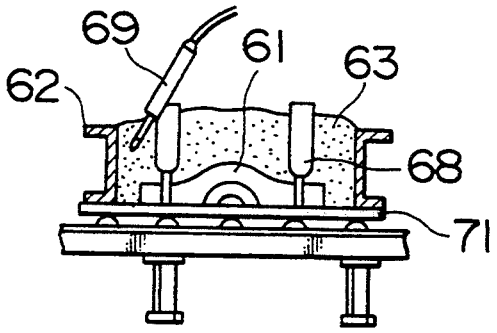
FIG. 19 PRIOR ART
FIG. 19 is a longitudinal sectional view of an apparatus for executing a conventional method of manufacturing a gas-hardening mold by hand molding.
Figure 20:
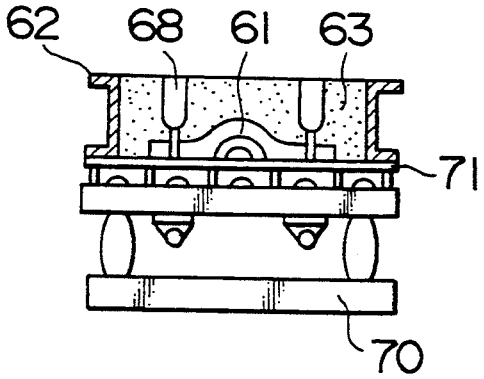
FIG. 20 PRIOR ART
FIG. 20 is a longitudinal sectional view of an apparatus for executing a conventional method of manufacturing a gas-hardening mold by two-dimensional jolt molding.

A flask 12 placed on a surface plate 24 was placed on the vibrating table 14 of the conventional two-dimensional jolt molding machine shown in FIG. 16, a pattern 11 was placed in the flask 12, furan self-hardening molding sand 13 was charged in a void portion formed by the pattern 11 and the flask 12, and the shakers 16 of the two-dimensional jolt molding machine were actuated thereby to fill the molding sand 13.

Then, this assembly was conveyed into a pressure reducing unit shown in FIG. 6, and was brought into a close contact with the upper surface of the flask 12 by descending a surface plate 19 for reduced-pressure suction provided with a reduced-pressure suction mechanism by means of a vertical working cylinder 18. Thereafter, a pressure reducing pump not shown was operated for five minutes and the pressure inside the flask 12 was reduced down to 200 mmHg through a suction pipe 20. After approximately 30 minutes had elapsed, the mold was ejected and the hardening state thereof was investigated. As a result, it was found that the ejection period could be reduced by half as compared with that in which no pressure reduction was made, and a good mold which was hardened uniformly up to the depth of the mold and had no deformation was also obtainable.

Embodiment-8

A flask 12 is placed through a surface plate 24 on the vibrating table 14 of the three-dimensional jolt molding machine shown in FIG. 6 and a pattern 11 to which a riser wood pattern 23 is fitted is installed therein. After charging an appropriate quantity (for example, $\frac{3}{4}$ of the total sand quantity) of furan self-hardening molding sand 13 mixed by a sand mixer in a void portion formed by the pattern 11 and the flask 12, the shakers 16 of the three-dimensional jolt molding machine were actuated, jolt in three directions of X-axis, Y-axis and Z-axis was applied, and the furan self-hardening molding sand 13 was charged in the flask 12. Then, an appropriate quantity (for example, $\frac{1}{4}$ of the total sand quantity) of furan self-hardening molding sand 13 was charged in the flask 12, and jolt filling was performed. After molding of the mold was completed, the mold was conveyed into the pressure reducing unit through the roller conveyor 17.

Next, a surface plate 19 for reduced-pressure suction provided with a reduced-pressure suction mechanism was descended by a vertical working cylinder 18 so as to be brought in close contact with the upper surface of the flask 12, a pressure reducing pump not shown was actuated for several minutes (for example, about 5 minutes) so as to reduce the pressure in the flask 12 (for example, 150 mmHg to 250 mmHg) through a suction pipe 20, and the moisture contained in the furan self-hardening molding sand 13 and the moisture generated at time of chemical reaction between furan resin which is a caking agent mixed with the molding sand and a hardening agent were evaporated thereby to be removed by dehydration through the suction pipe 20. Furthermore, the mold ejected after being left as it was for about 30 minutes showed a good mold having no deformation, and the hardening period was not only reduced by half, but also the filling density was high, and which was hardened uniformly up to the central part thereof, as compared with a conventional mold left as it was with no pressure reduction. Also, Table 2 shows reduced-pressure suction hardening characteristics of the furan self-hardening molding sand.

TABLE 2

Reduced-Pressure Suction Hardening Characteristics of Furan Self-Hardening Molding Sand

| Resin | | Hardening agent | | Reduced- | Tensile Strength (kg/cm$^2$) after | | |
|---|---|---|---|---|---|---|---|
| Type | wt % | Type | wt % | pressure | 30 m. | 1 Hr | 24 Hr |
| 340B | 1.0 | C-14 | 40 | no | 0 | 2.8 | 37.5 |
| 340B | 1.0 | C-14 | 40 | yes | 3.9 | 9.4 | 40.8 |
| 340B | 1.0 | TK-3 | 40 | no | 5.2 | 11.8 | 36.0 |
| 340B | 1.0 | TK-3 | 40 | yes | 13.6 | 28.2 | 39.5 |

Note)
Wt % of hardening agent is shown with a ratio to resin.
Tested sand: Kaketsu Fusen No. 5
Ambient temperature: 28° C.
Humidity: 90% RH
Degree of pressure reduction: −150 mmHg
Behavior of hardening: Uniform hardening to the depth (in case of reduced-pressure hardening)

<Examples of manufacturing a core and a mold using gas-hardening molding sand>

Embodiment-9

Figure 7:
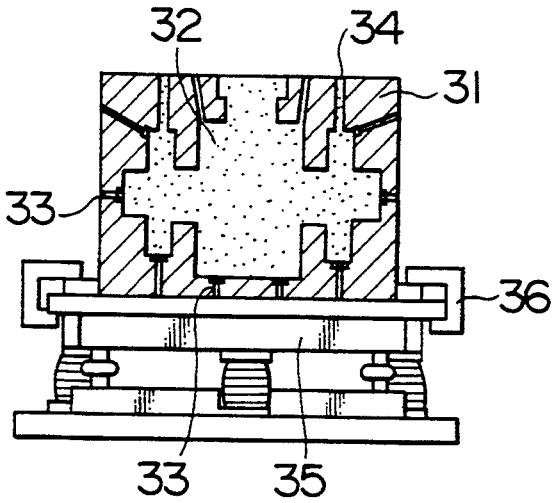
FIG. 7 is a longitudinal sectional view of an apparatus according to an embodiment 9 for executing a method of manufacturing a gas-hardening core of the present invention.
Figure 8:
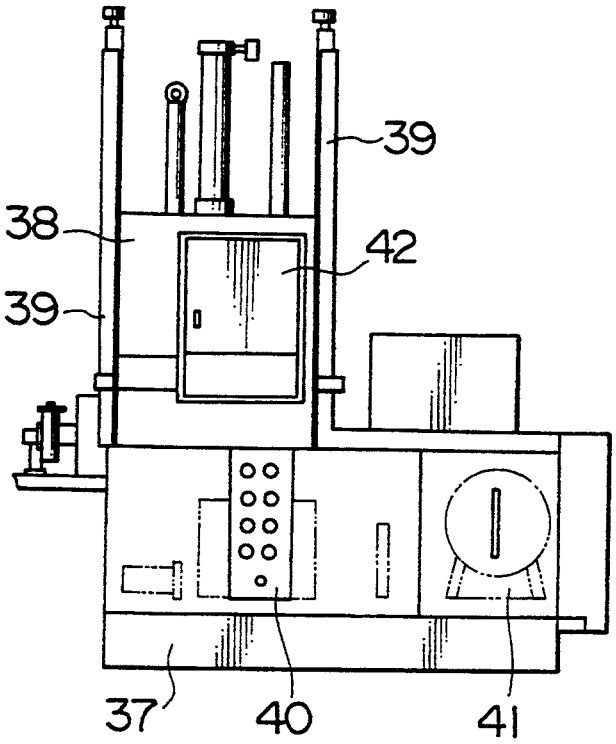
FIG. 8 is a side view of a methyl formate generator which is used in an embodiment 9 of the present invention.

An embodiment 9 will be described with reference to FIG. 7 and FIG. 8.

In these figures, 31 denotes a core pattern, denotes gas-hardening molding sand, 33 denotes vent holes, 34 denotes by-pass holes for sand replenishment, 35 denotes a three-dimensional jolt molding machine, 36 denotes a clamp, 37 denotes a generator, 38 denotes a box, 39 denotes a door, 40 denotes a pressure regulator, 41 denotes a methyl formate tank, and 42 denotes a control board.

A core pattern 31 was placed on the table of the three-dimensional jolt molding machine 35, and fixed with a clamp 36. Thereafter, ester gas-hardening molding sand 32 mixed separately (silica sand No. 6 100% and alkaline phenol resin 2.2%) was charged through core print portions and bypass holes 34 for sand replenishment at the upper part of the core pattern 31, and X-Y jolt was applied. After filling for 30 seconds, ester gas-hardening molding sand 32 add' was charged and jolted for 15 seconds with Y-Z jolt, and jolt in two directions and jolt in one direction were repeated thereafter. After the core was thus molded, the core pattern 31 was inserted into the box 38 of the generator 37, the door 39 was closed, and methyl formate gas the pressure of which was regulated with the pressure regulator 40 was supplied, thus hardening the core. The result of ejecting the core out of the core pattern 31 and investigating the accuracy and the filling state of the core showed a much better state as compared with a core by hand molding or by two-dimensional jolt molding and hand molding combined.

Embodiment-10

Figure 9:
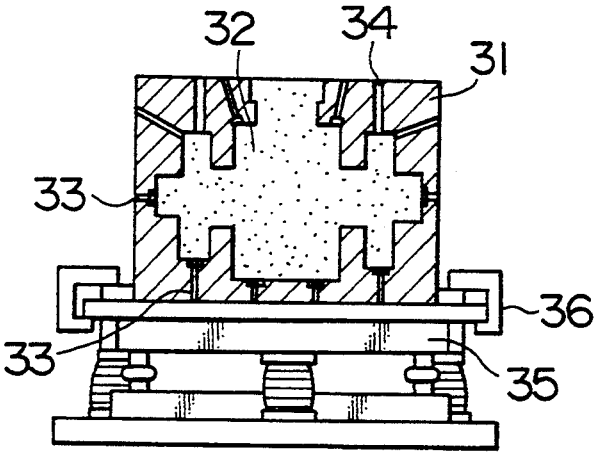
FIG. 9 is a longitudinal sectional view of an apparatus according to an embodiment 10 for executing a method of manufacturing a gas-hardening core of the present invention.
Figure 10:
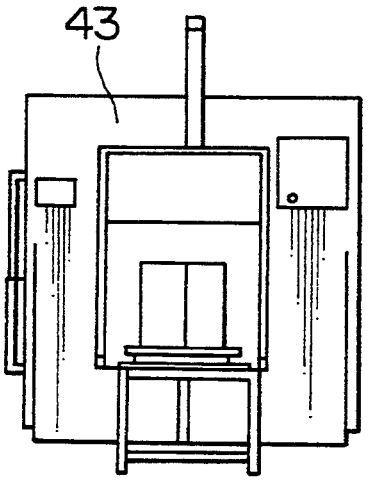
FIG. 10 is a side view of an amine gas blowing apparatus used in an embodiment 10.

An embodiment 10 will be described with reference to FIG. 9 and FIG. 10.

In these figures, 31 to 36 denote members similar to those of the embodiment 9, and 43 denotes an amine gas blowing apparatus.

A core pattern 31 was disposed on the table of the three-dimensional jolt molding machine 35, and fixed with a clamp 36. Thereafter, cold box molding sand 32 mixed separately (silica sand No. 6 100%, isocurepart 1–0.75% and isocurepart 2–0.75%) was charged through core print portions and bypass holes 34 for sand replenishment at the upper part of the core pattern 31, and the core was molded by a method similar to the embodiment 8. Thereafter, the core pattern 31 was inserted into the amine gas blowing apparatus 43 and the amine gas was supplied for a predetermined period of time. As the result of ejecting the core out of the core mold 31 after the core hardened and investigating the dimension and the filling state, a good core was obtainable similarly to the embodiment 9.

Embodiment-11

An embodiment 11 will be described with reference to FIG. 7.

$SO_2$ process molding sand mixed separately (silica sand No. 6 100%, furan resin 1.0% and peroxide 50% to furan resin) was charged in a core pattern 31 installed on a three-dimensional jolt molding machine 35 and the core was molded by a method similar to the embodiment 9. Thereafter, sulfur dioxide was supplied for hardening. A core having high dimensional accuracy and high filling density as compared with a core of hand molding or of a two-dimensional jolt molding machine and hand molding combined was obtainable.

Embodiment-12

Figure 11:
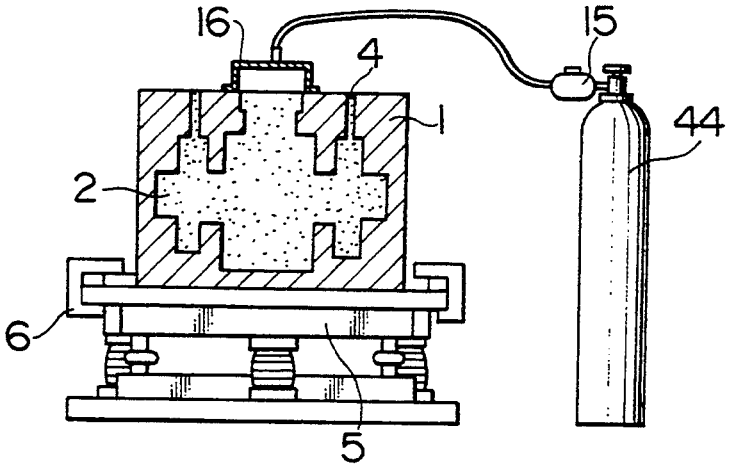
FIG. 11 is a longitudinal sectional view of an apparatus according to an embodiment 12 for executing a method of manufacturing a gas-hardening core of the present invention.

An embodiment 12 will be described with reference to FIG. 11.

In the figure, 44 denotes carbon dioxide gas, 45 denotes a gas pressure regulator and 46 denotes a gas blowing jig. After a core was manufactured by a method similar to the embodiment 9 using $CO_2$ molding sand mixed separately (silica sand No. 6 100%, sodium silicate 5% and pitch 1%), the carbon dioxide gas 44 was supplied in the core pattern 31 through the gas pressure regulator 45, thus hardening the $CO_2$ molding sand. When the state of the core was investigated, a core having high dimensional accuracy and high filling density was obtainable.

Embodiment-13

Figure 12:
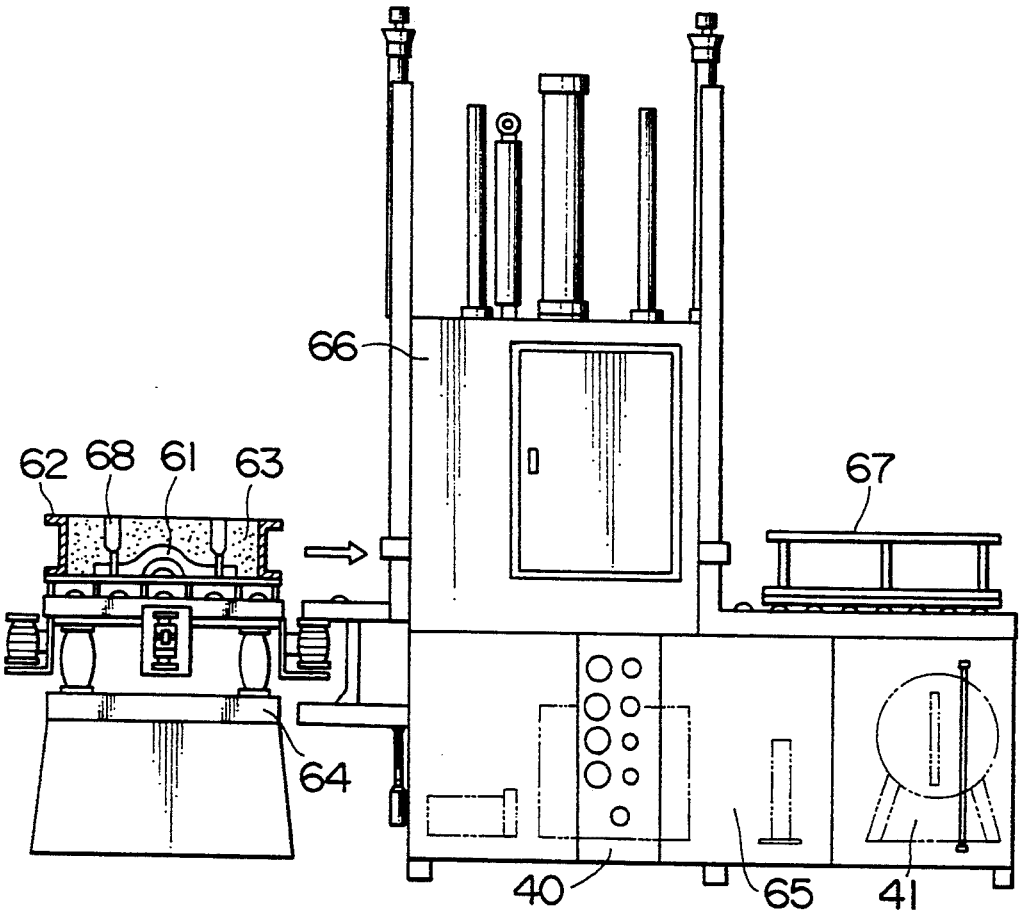
FIG. 12 is a longitudinal sectional view of an apparatus according to an embodiment 13 for executing a method of manufacturing a gas-hardening mold of the present invention.
Figure 13:
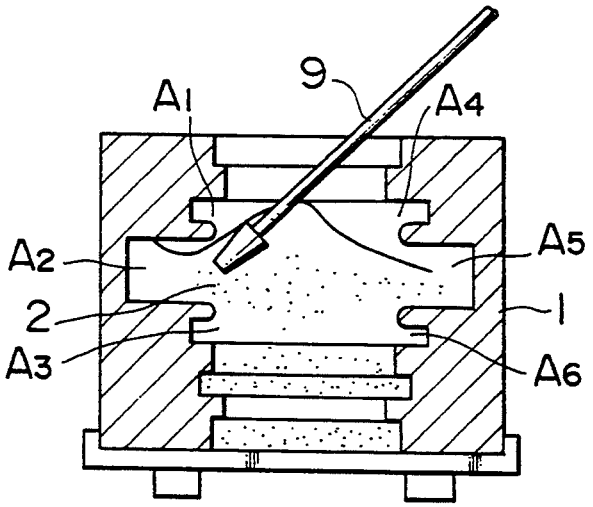
FIG. 13 PRIOR ART
FIG. 13 is a longitudinal sectional view of an apparatus for executing a conventional method of manufacturing a core.
Figure 14:
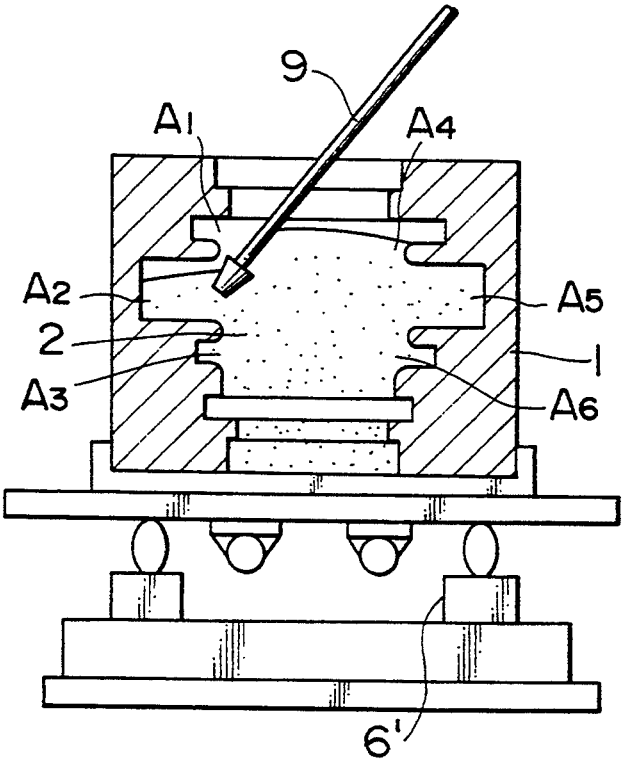
FIG. 14 PRIOR ART
FIG. 14 is a longitudinal sectional view of another apparatus for executing a conventional method of manufacturing a core.
Figure 15:
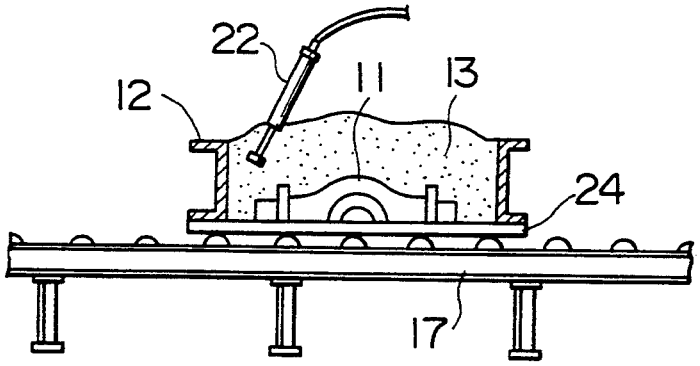
FIG. 15 PRIOR ART
FIG. 15 is a partial longitudinal sectional side view of an apparatus for executing a conventional method of manufacturing a self-hardening mold.

An embodiment 13 will be described with reference to FIG. 12.

The present embodiment relates to a principal mold, in which 61 denotes a pattern, 62 denotes a flask, 63 denotes gas-hardening molding sand, 64 denotes a three-dimensional jolt molding machine, 65 denotes a generator, 66 denotes a box, 67 denotes a mold and 68 denotes a riser wood pattern.

A satisfactory result was also obtainable similarly to core molding in the cases of cold box (isocure) molding sand, $SO_2$ process (hardox) molding sand and $CO_2$ molding sand.

An embodiment of ester gas-hardening molding sand will be described herein as a typical example.

A surface plate fitted with the pattern 61 is disposed on the table of the three-dimensional jolt molding machine 64, and the flask 62 is set thereon. A riser wood pattern 68 is fitted to the pattern 61, and after ester gas-hardening molding sand 63 (silica sand No. 6 100% and alkaline phenol resin 2.2%) is charged in the flask 62, the three-dimensional jolt molding machine 64 is actuated and three-dimensional jolt (X, Y, Z) and two-dimensional jolt (X-Y, X-Z, Y-Z) are applied to the flask 62 for an arbitrary period of time. After molding of the mold is completed, the mold is conveyed into the box 66 of the generator 65, and methyl formate gas is supplied so as to harden the mold.

As a result of confirming the workmanship of the mold 67 with the pattern 61 and the riser wood pattern 68 removed, a good mold having high filling density without uneven molding was obtainable as compared with a mold molded with a two-dimensional jolt molding machine or a sand rammer for ramming.

We claim:

1. A method of manufacturing a core, comprising the steps of:

providing a core box;

charging a predetermined amount of a self-hardening sand into the core box, said self-hardening sand containing a binder and water, which predetermined amount is less than a total amount of the self-hardening sand necessary for manufacturing of the core:

simultaneously, applying to the core box a jolt of between more than 2.0 G and less than 5.0 G in three directions by applying at least one of a three-dimensioned jolt and a predetermined combination of two-dimensional and one-dimensional jolts;

thereafter, charging a further amount of the self-hardening sand, which further amount, together with a previously charged amount, should not exceed the total amount of the self-hardening sand necessary for manufacturing of the core;

simultaneously, applying to the charged further amount the jolt of between more than 2.0 G and less than 5.0 G in three directions in accordance with a predetermined scheme; and precipitating an air flow in the core box by sucking an inside of the core box upon filling the core box with the self-hardening sand.

2. The method of claim 1, further comprising the steps of providing holes of a predetermined size in corner portions of the core box; communicating the holes with sucking means, which is used for sucking the inside of the core box; and charging the self-hardening sand into the core box while precipitating air flow in the core box by sucking air through the holes to thereby facilitate filling of the corner portions of the core box with the sand.

3. The method of claim 2, wherein said hole providing step includes providing the holes in a recessed portion of the core box.

4. A method of manufacturing a core, comprising the steps of:

providing a core box;

charging a predetermined amount of a self-hardening sand into the core box, which predetermined amount is less than a total amount of the self-hardening sand necessary for manufacturing of the core, said self-hardening sand containing a binder and water;

simultaneously, applying to the charged self-hardening sand a jolt of between more than 2.0 G and less than 5.0 G in three directions by intermittently applying a predetermined combination of a three-dimensional jolt and a two-dimensional jolt to the core box.

5. The method of claim 4, further comprising the steps of providing holes of a predetermined size in corner portions of the core box; communicating the holes with sucking means and charging the self-hardening sand into the core box while precipitating air flow in the core box by sucking air through the holes to thereby facilitate filing of the corner portions of the core box with the sand.

6. The method of claim 5, wherein said hole providing step includes providing the holes in recessed portion of the core box.

7. A method of manufacturing a self-hardening casting mold, comprising the steps of:

placing a flask on a surface plate of an apparatus for manufacturing casting molds;

placing a casting mold pattern in the flask;

filling a space between the flask and the casting mold pattern with a self-hardening casting sand, said self-hardening sand containing a binder and water; and applying to the surface plate a jolt of between more than 2.0 G and less than 5.0 G by applying, to the surface plate, one of a continuous three-dimensional jolt and an intermittent three-dimensional jolt.

* * * * *